US005734957A

United States Patent [19]

Ogawa et al.

[11] Patent Number: 5,734,957

[45] Date of Patent: Mar. 31, 1998

[54] IMAGE FORMING APPARATUS WITH TONER RE-USE FEATURE

[75] Inventors: Hiroshi Ogawa, Yokohama; Masami Maetani, Ageo, both of Japan

[73] Assignee: Canon Kabushiki Kaisha, Tokyo, Japan

[21] Appl. No.: 359,731

[22] Filed: Dec. 20, 1994

[30] Foreign Application Priority Data

Dec. 22, 1993 [JP] Japan ..... 5-345649
Dec. 5, 1994 [JP] Japan ..... 6-300939

[51] Int. Cl.[6] ..... G03G 21/10

[52] U.S. Cl. ..... 399/359; 399/255

[58] Field of Search ..... 355/298, 301, 355/304, 305, 251; 118/652; 399/359, 120, 255, 358, 360, 258, 259

[56] References Cited

U.S. PATENT DOCUMENTS

| | | | |
|---|---|---|---|
| 4,389,968 | 6/1983 | Satomura | 118/652 |
| 4,768,055 | 8/1988 | Takamatsu et al. | 355/298 |
| 4,894,688 | 1/1990 | Taniguchi et al. | 355/298 |
| 5,200,788 | 4/1993 | Thayer | 355/298 |
| 5,307,128 | 4/1994 | Murasaki et al. | 355/298 X |
| 5,455,666 | 10/1995 | Saito et al. | 355/298 |
| 5,481,351 | 1/1996 | Kawai et al. | 355/298 |
| 5,486,905 | 1/1996 | Takeda et al. | 355/298 X |
| 5,499,090 | 3/1996 | Ito et al. | 355/298 |

FOREIGN PATENT DOCUMENTS 2-11913 3/1990 Japan .

*Primary Examiner*—S. Lee
*Attorney, Agent, or Firm*—Fitzpatrick, Cella, Harper & Scinto

[57] ABSTRACT

An image forming apparatus for forming an image on a recording medium includes an image bearing member, a developing device for developing a latent image formed on the image bearing member, a toner container for containing non-used toner to be used in development by the developing device, a transfer device for transferring a toner image formed on the image bearing member by the developing device onto the recording medium, a cleaning device for removing residual matter adhered to the image bearing member after the toner image was transferred by the transfer device, a separating device for separating foreign matter from toner removed from the image bearing member by the cleaning device, and a toner from which the foreign matter is removed by the separating device with the non-used toner from the toner container to the developing device.

29 Claims, 7 Drawing Sheets

IMAGE FORMING APPARATUS WITH TONER RE-USE FEATURE

BACKGROUND OF THE INVENTION

1. Field of the Invention

The present invention relates to an image forming apparatus for forming an image on a recording medium, and more particularly it relates to an image forming apparatus such as an electrophotographic copying machine, an electrophotographic printer and the like utilizing an electrophotographic image forming process.

2. Related Background Art

In electrophotographic image forming apparatuses the operation of which includes a step of transferring a toner formed on an image bearing member onto a recording medium such as a paper sheet, after a transferring operation, toner (not transferred to the recording medium) remains on a surface of the image bearing member. Thus, after the transferring operation, it is necessary to remove the residual toner from the image bearing member.

In this regard, there has been proposed a technique wherein the waste toner removed from the image bearing member is collected and returned to a developing means to be used again. In order to re-use the waste toner, the toner collected by a cleaning device is returned to the developing means or a hopper associated with the developing means as it is, or foreign matter such as paper powder are removed from the waste toner and then the toner is returned to the developing means.

In any case, conventionally, it is common that the toner collected by the cleaning device is returned to the developing means or the hopper through an exclusive convey path. In this case, there arises a risk that the toner returned from the cleaning device is not adequately mixed with the toner remaining in the developing means or the hopper, or, even when these toners are mixed together, the mixing rate becomes unstable or uneven. As a result, there arises problem that density of image is worsened and/or a so-called "fog" is generated in the image, thereby deteriorating the image quality.

SUMMARY OF THE INVENTION

An object of the present invention is to provide an image forming apparatus in which toner can effectively be re-used in image formation.

Another object of the present invention is to provide an image forming apparatus in which a high quality image can be obtained even when toner is re-used in image formation.

A further object of the present invention is to provide an image forming apparatus wherein new toner supplied from a hopper to a developing means is sufficiently mixed with toner returned from a cleaning device for re-usage, thereby stably obtaining a good quality image while re-using the toner effectively.

The other object of the present invention is to provide an image forming apparatus wherein a good quality image can be obtained by using mixture obtained after non-used toner and re-used toner are mixed satisfactorily.

DETAILED DESCRIPTION OF THE PREFERRED EMBODIMENTS

First of all, an embodiment of an electrophotographic copying machine as an image forming apparatus to which the present invention is applied will be explained with reference to the accompanying drawings.

Figure 1:
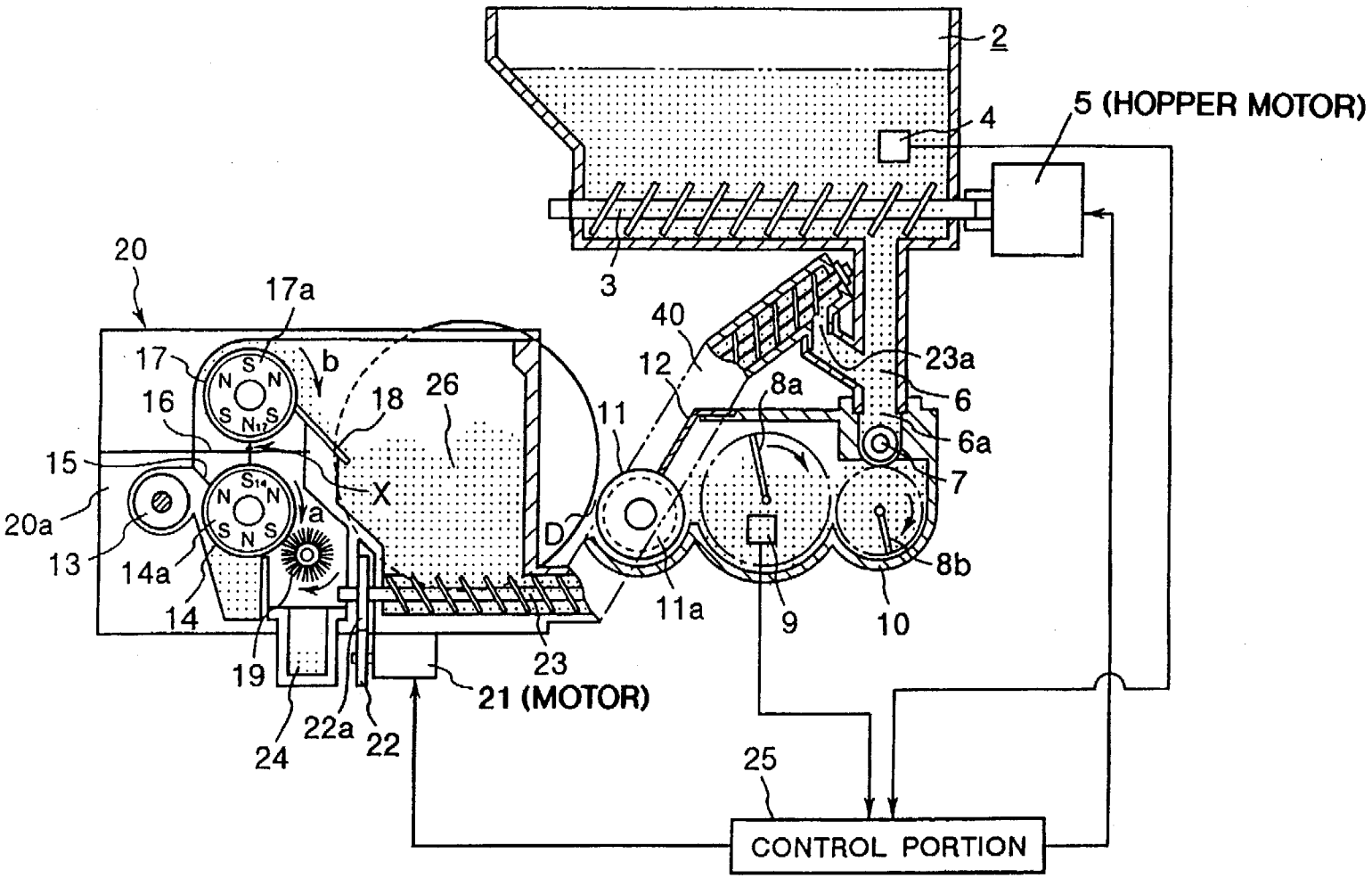
FIG. 1 is an elevational sectional view showing main portions of an image forming apparatus according to a preferred embodiment of the present invention.
Figure 2:
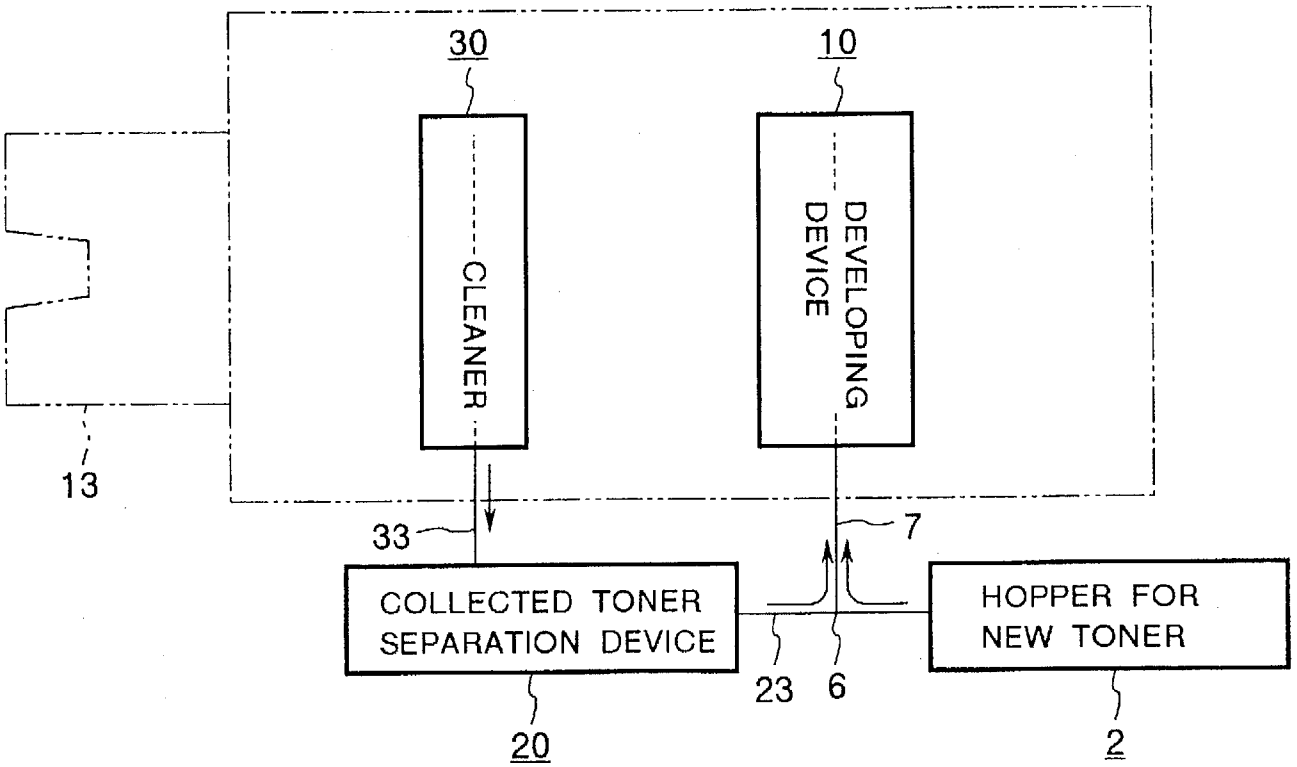
FIG. 2 is a view showing a positional relation between various elements of the image forming apparatus of FIG. 1.

FIG. 1 is an elevational sectional view showing main portions of an electrophotographic copying machine according to a preferred embodiment of the present invention, particularly showing a developing device 10, a hopper 2, a separation device 20 for separating foreign matter from toner discharged from a cleaner 30, and a convey path for conveying the toner (from which the foreign matter is separated) toward the developing device. Further, FIG. 2 is a schematic view showing a positional relation between the developing device 10, hopper 2, cleaner 30 and separation device 20. Incidentally, FIG. 6 is a schematic sectional view of an electrophotographic copying machine as an image forming apparatus to which the present is applied.

Figure 6:
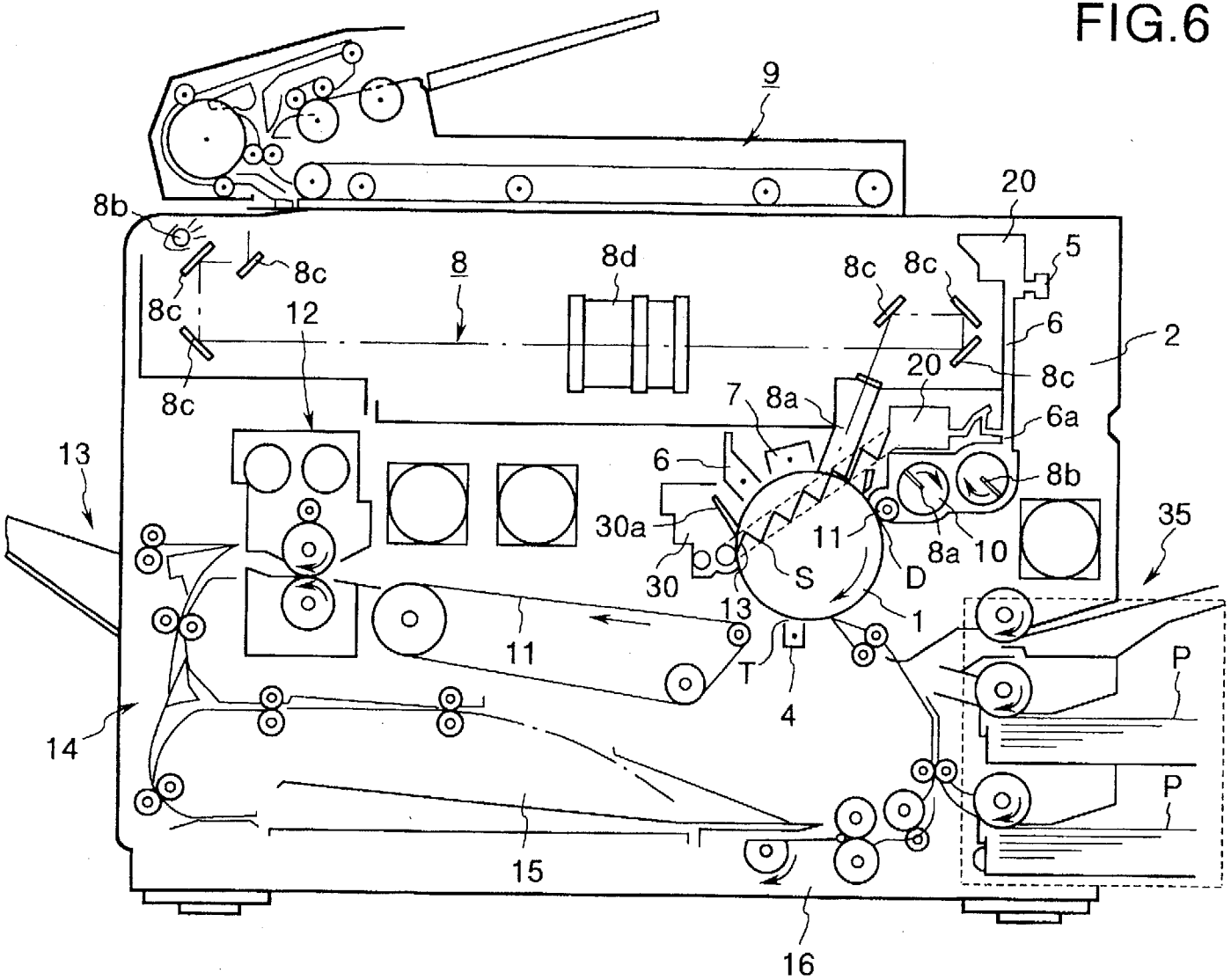
FIG. 6 is an elevational sectional view of an image forming apparatus to which the present invention is applied.

In FIG. 6, a latent image formed on an image bearing member (for example, an electrophotographic photosensitive drum) 1 is visualized or developed with developer (one-component magnetic toner in the illustrated embodiment) by a developing device 10 as a toner image. The toner is replenished to the developing device 10 from a hopper 2. The toner image formed on the photosensitive drum 1 is transferred onto a sheet (recording medium) by a transfer means 4. After a transferring operation, the residual toner or other foreign matter remaining on the photosensitive drum 1 are removed by a cleaning device 30. The electricity on the photosensitive drum 1 is removed by an electricity removal means 6, and then the photosensitive drum 1 is uniformly charged by a first charger 7. Image information of an original is read by an optical reading system 8 (including a lamp 8*b*, a mirror 8*c* and a lens 8*d*). The read image information is exposed on the photosensitive drum 1 by an exposure portion 8*a* to form a latent image on the photosensitive drum. The original is directed to an image reading portion by an original processing device 9. The sheet P is sent from a sheet supply portion 35 to an image forming portion. The sheet to which the image was transferred at a transfer station is sent, through a convey means 11, to a fixing device 12, where the image is fixed to the sheet P. Then, the sheet is discharged onto a sheet discharge portion 13. In a both-face recording mode or a multi-recording mode, the sheet discharged from the fixing device 12 is introduced into a re-supply sheet introduction portion 14 and then is temporarily stored on an intermediate tray 15. The sheets stored on the intermediated tray are re-supplied one by one to the image forming portion by a sheet re-supply portion 16.

Next, an operation of the image forming apparatus will be explained. When a copy start button (not shown) is depressed, the original in the original processing device 9 is introduced into the image reading portion. Then, the image information of the original is read by the optical reading system 9. On the other hand, the photosensitive drum 1 from which the electricity was previously removed by the electricity removal means 6 is uniformly charged by the first charger 7. Thereafter, at the exposure portion 8*a*, the read image information is written on the photosensitive drum 1 as a latent image. The latent image is visualized by the developing device 10 with the magnetic toner as a toner image. In this case, if an amount of the magnetic toner in the developing device 10 is greatly decreased, new magnetic toner is replenished to the developing device from the hopper 2 and a reservoir 26, as will be described later. When the sheet P is sent from the sheet supply portion 10 to the transfer station of the image forming portion, the toner image formed on the photosensitive drum 1 is transferred onto the sheet P by the transfer means 4. After the transferring operation, the sheet P is sent, through the convey means 11, to the fixing device 12, where the toner image is fixed to the sheet P. After a fixing operation, in a one-face recording mode, the sheet P is discharged onto the sheet discharge portion 13 as it is.

On the other hand, in a both-face recording mode or a multi-recording mode, the sheet is not discharged onto the sheet discharge portion 13, but is stored on the intermediate tray 15 through the re-supply sheet introduction portion 14. After a predetermined number of sheets are stored on the intermediate tray, the sheets are re-supplied one by one to the transfer station of the image forming portion by the sheet re-supply portion 16. Then, when a next original in the original processing device 9 is introduced into the image reading portion, the above-mentioned processes are repeated, thereby fixing an image to the other surface of the sheet. After the fixing operation, the sheet is discharged onto the sheet discharge portion 13.

The toner (not transferred to the sheet P by the transfer means 4 during the transferring operation) and other foreign matter (such as paper powder, dust and the like) remaining on the photosensitive drum 1 are removed by the cleaning device 30 (in the illustrated embodiment, the residual toner and other foreign matter are removed by an elastic cleaning blade 30*a*). The removed toner and other foreign matter are sent, by a screw, to a separating device 20 which will be described later.

Next, the separating device for separating the foreign matter from the magnetic toner collected by the cleaning device 30 will be explained with reference to FIG. 1.

In FIG. 1, the separating device 20 has a frame 20*a* within which a mesh filter 16 made of non-magnetic material (for example, non-magnetic stainless steel wires, non-magnetic brass wires, nylon fibers or the like) is arranged along a direction substantially perpendicular to a gravity acting direction (i.e., at an inclination angle of 0° with respect to a horizontal plane). Non-magnetic sleeves 14, 17 (for example, made of aluminum) incorporating respective magnet rollers 14*a*, 17*a* are disposed above and below the mesh filter 16. Incidentally, as shown in FIG. 1, each magnet roller 14*a*, 17*a* has N poles alternately arranged. In a condition that magnetic poles $S_{14}$ and $N_{17}$ of the magnet rollers 14*a*, 17*a* are opposed to each other as shown in FIG. 1, the sleeves 14, 17 are rotated in directions shown by arrows a, b in FIG. 1. That is to say, the sleeves 14, 17 are rotated in opposite directions. By the rotation of the sleeve 14, the residual matter adhered to a surface of the sleeve 14 is shifted in the same direction as the rotational direction of the sleeve 14. On the other hand, by the rotation of the sleeve 17, the magnetic toner adhered to a surface of the sleeve 17 is shifted in the same direction as the rotational direction of the sleeve 17.

Incidentally, a relation between magnetic forces of the magnetic poles $S_{14}$, $N_{17}$ at a separating zone X where the sleeves 14, 17 are opposed to each other with the interposition of the mesh filter 16 by which the foreign matter are separated from the magnetic toner is $N_{17}>S_{14}$.

Further, a convey screw 13 for conveying the residual matter serves to convey the magnetic toner and the foreign matter collected in the cleaning device 30 to the separating device 20, and a convey screw 23 for conveying the toner serves to convey the magnetic toner (from which the foreign matter were removed) to the developing device 10. A doctor blade 15 serves to regulate a thickness of a layer of the residual matter adhered to the sleeve 14, and a scraper blade 18 serves to scrape the magnetic toner adhered to the sleeve 17 and to guide the scraped toner to the reservoir 26.

Next, a separating operation of the separating device 20 for separating the foreign matter from the magnetic toner will be explained. First of all, the mixture of the magnetic toner and the foreign matter removed from the image bearing member 1 by the cleaning device 30 is supplied to the proximity of the sleeve 14 in the separating device 20 by means of the convey screw 13. Then, the mixture is adhered to the surface of the sleeve 14 to be conveyed upwardly by the rotation of the sleeve 14. That is to say, the mixture is sent to the separating zone X. Although the foreign matter such as paper powder is non-magnetic. Since it is mixed with the magnetic toner when the residual matter is removed from the image bearing member 1, the foreign matter is adhered to the surface of the sleeve 14 together with the magnetic toner. A thickness of a layer of the mixture of the magnetic toner and the foreign matter adhered to the sleeve 14 is regulated by the doctor blade 15, and the mixture is sent to the separating zone X where the sleeves 14, 17 are opposed to each other.

As mentioned above, the relation between the magnetic poles $S_{14}$ and $N_{17}$ at the separating zone X is $N_{17}$ $S_{14}$. Thus, the mixture sent to the separating zone X by the sleeve 14 is flying from the surface of the sleeve 14 toward the surface of the sleeve 17 under the action of magnetic fields formed by the magnet rollers 14*a*, 17*a*. In this case, since there is the mesh filter 16 between the sleeves 14, 17, only the magnetic toner having small particle diameter can pass through the mesh of the mesh filter 16, and the foreign matter such as paper powder each having particle diameter remarkably greater than that of the magnetic toner cannot pass through the mesh filter 16.

Since the mesh of the mesh filter 16 (preferably, 150 μm (#100) to 37.5 μm (#400)) has an opening greater than the particle diameter of the magnetic toner (average particle diameter of 5 to 20 μm) by several times, the magnetic toner can smoothly pass through the mesh of the filter.

On the other hand, since the magnetic toner adhered to the foreign matter is flying toward the surface of the sleeve 17, an amount of the magnetic toner on the foreign matter is greatly decreased, with the result that a force for flying the foreign matter in opposition to the gravity force is greatly reduced, thereby dropping the foreign matter onto the surface of the sleeve 14 by its own weight. Accordingly, the foreign matter are separated from the magnetic toner.

Now, an example of concrete values regarding the separating device according to the aforementioned embodiment will be described. However, the present invention is not limited to such values.

First of all, the filter 16 is formed as a stainless steel mesh filter, and each opening thereof has a dimension of about 75 μm (#200). Further, a transverse length of the filter 16 is about 70 mm, a longitudinal length of the filter is about 40 mm, and a thickness of the filter is about 0.1 mm.

Further, the sleeves 14, 17 are made of aluminum and each has an outer diameter of about 20 mm. An outer diameter of each of the magnets 14*a*, 17*a* incorporated into the sleeves 14, 17 is 17.6 mm, and a distance between the sleeves 14 and 17 is about 3 mm. Furthermore, the $S_{14}$ pole has about 650 gauss and $N_{17}$ pole has about 1000 gauss. From the view point of developing ability and image quality, it is preferable that a weight average particle diameter ($D_4$) of the toner used in the illustrated embodiment is 3 to 12 μm (preferably, 3 to 10 μm, and, more preferably, 3 to 8 μm).

Although the grain size distribution of the toner can be measured by various method, in the present invention, it was measured by using a Coaltar counter.

For example, a Coaltar counter TA-II (manufactured by Coaltar Co.) was used as a measuring device, and interfaces (manufactured by Nikkaki Co. in Japan) for outputting number distribution and volume distribution and a personal computer CX-I (manufactured by Canon Co. in Japan) were connected to the measuring device. Aqueous solution including NaCl of 1% prepared by using first class sodium chloride was used as electrolyte. In the measurement, surface-active agent (preferably, alkyl benzene sulfonate) of 0.1 to 5 ml was added to the electrolytic solution of 100 to 150 ml as dispersing agent, and sample to be measured of 2 to 20 mg was also added to the electrolytic solution. The electrolytic solution including the sample suspension was subjected to the dispersing treatment for about 1 to 3 minutes by using a supersonic dispersing device. Thereafter, the volume of the toner and the number of toner articles were measured by the Coaltar counter TA-II using an aperture of 100 μm, thereby calculating the volume distribution and number distribution of toner particles of 2 to 40 μm. Thereafter, regarding the present invention, the weight average diameter (central value of each channel is used as a representative value of each channel) of weight reference sought from the volume distribution and standard deviation thereof, and a length average diameter of number reference sought from the number distribution and standard variation thereof were determined.

In the aforementioned embodiment, the separating device 20 is operated when the copy start button (not shown) of the image forming apparatus is depressed, and is stopped when the copying operation is finished. That is to say, the separating device is driven in synchronous with the rotation of the photosensitive drum (image bearing member) 1.

Agitating rods 8*a*, 8*b* are arranged within the developing device 10 so that the toner in the developing device is shifted toward a rotating developing sleeve 11 having a magnet roller 11*a* therein while agitating the toner. A thickness of a toner layer adhered to the developing sleeve 11 is regulated by a regulating blade 12, and the regulated toner layer reaches a developing station D where the developing sleeve is opposed to the image bearing member 1. At this developing station D, the electrostatic latent image is developed with the toner as the toner image.

After the toner image is transferred onto the sheet P at the transfer station T (FIG. 6), the residual toner (not transferred to the sheet P) remaining on the image bearing member 1 is removed by the cleaning device 30. As shown in FIGS. 2 and 6, the removed waste toner is conveyed to the separating device 20 by the screw 13 through a convey path S extending from the cleaning device 30 to the separating device 20. Incidentally, the residual toner remaining on the image bearing member 1 is scraped by the elastic cleaning blade 30*a* to be collected in the cleaning device 30.

The toner from which the foreign matter such as paper powder were removed by the separating device 20 is supplied to the convey path 6 by the convey screw 23 through the toner reservoir 26 provided in the separating device 20. Then, the toner (re-used toner) from which the foreign matter is removed is appropriately mixed with the toner (non-used toner) supplied from the hopper 2, by the convey screw 7 arranged outside of the developing device 10. Thereafter, the mixed toner is agitated by the agitating rods 8*a*, 8*b* disposed in the developing device 10 and then is sent to a developing area D of the developing sleeve 11 to be used in the developing operation. Incidentally, the toner reservoir 26 is connected to the convey path 5 through a convey path 40 within which the convey screw 23 is disposed.

An amount of toner in the developing device 10 is detected by a sensor 9. When the amount of toner in the developing device 10 is decreased below a predetermined amount, a toner replenish signal is emitted from the sensor 9 to a control portion 25 so that a hopper motor 5 is driven in response to an output signal from the control portion 25, thereby driving the screw 3 in the hopper 2 to supply the toner in the hopper 2 to the developing device 10 through the convey path 6. Now, the "non-used toner" means new toner which is not yet used in the developing operation, and the "re-used toner" means toner from which the foreign matter is removed after it was used in the developing operation.

As mentioned above, the used toner collected in the cleaning device 30 is sent to the separating device 20 by the convey screw 13 disposed in the convey path S extending from the cleaning device 30 to the separating device 20.

Incidentally, as mentioned above, two sleeves 14, 17 are arranged in the separating device 20 for rotation in directions a, b with the interposition of the filter 16 made of non-magnetic material. The magnets 14*a*, 17*a* are disposed within the sleeves 14, 17, respectively, and each of the magnets 14*a*, 17*a* has S poles and N poles arranged alternately along a circumferential direction. At the separating zone X where the sleeves 14, 17 are opposed to each other with the interposition of the filter 16, opposite poles of the magnets 14*a*, 17*a* are opposed to each other, and it is designed to have a relation {(magnetic force of magnet 17*a*)>(magnetic force of magnet 14*a*)}.

With this arrangement, the mixture of magnetic toner and foreign matter sent from the cleaning device 30 to the separating device 20 by the convey screw 13 is firstly adhered to the peripheral surface of the sleeve 14 by a magnetic force, and, after the thickness of the layer of the mixture adhered to the sleeve 14 is regulated by the regulating blade 15, the mixture is brought to the separating zone X by the rotation or the sleeve 14. Due to the difference in magnetic force between the magnets 14*a* and 17*a*, the toner (fine powder) is flying toward the sleeve 17 through the filter 16 and is adhered to the peripheral surface of the sleeve 17. However, the paper powder, aggregated toner lumps and the like (foreign matter) which have diameters adequately greater than a diameter of the toner particle cannot pass through the filter 16 and are dropped onto the sleeve 14. As the sleeve 14 is further rotated, the separated foreign matter is scraped from the peripheral surface of the sleeve 14 by a non-magnetic brush 19 to be collected in a collecting portion 24. Incidentally, although not shown, the filter 16 may be positively vibrated by an appropriate vibrating means to drop out the foreign matter caught by the filter 16 from the filter and to decompose the aggregated toner lumps for facilitating the toner to pass through the filter.

On the other hand, the toner (which was passed through the filter 16 and from which the foreign matter is removed)

adhered to the peripheral surface of the sleeve 17 is conveyed as the sleeve 17 is rotated, and then is scraped from the sleeve 17 by a scraper blade 18 to be collected into the toner reservoir 26 in the separating device 20.

When the amount of toner in the developing device 10 is decreased below the predetermined amount, a motor 21 is driven by the control portion 25 in response to the toner replenish signal emitted from the sensor 9. As a result, the convey screw 23 in the reservoir 26 is driven to send the toner in the reservoir 26 from an outlet 23*a* of the screw 23 to the developing device 10 through the convey paths 40 and 6.

As mentioned above, the new toner (non-used toner) in the hopper 2 is also sent to the developing device 10 in response to the toner replenish signal emitted from the sensor 9 of the developing device 10. Accordingly, both the new toner (non-used toner) from the hopper 2 and the toner (re-used toner) (from which the foreign matter is removed) from the toner reservoir 26 are supplied to the developing device 10 in combination. In this case, when the non-used toner and the re-used toner enter into the developing device 10, they are mixed with each other by the screw 7 disposed at a junction between the convey path 6 and the developing device 10. They are further mixed by the agitating rods 8*a*, 8*b*, and the completely mixed toner is adhered to the peripheral surface of the developing sleeve 11 by the magnetic force. Accordingly, the toner (to be supplied to the latent image formed on the image bearing member 1) adhered to the peripheral surface of the developing sleeve 11 becomes uniform (by completely mixing the non-used toner and the re-used toner), thereby obtaining a high quality image.

Particularly, in the illustrated embodiment, when the re-used toner stored in the toner reservoir 26 is supplied to the developing device 10, the re-used toner is not directly sent to the developing device 10, but is sent to the developing device 10 through the convey path 6 for supplying the non-used toner from the hopper 2 to the developing device 10. Accordingly, the reused toner and the non-used toner are mixed with each other when they are conveyed through a common portion 6*a* of the convey path 6. Further, after being passed through the common portion 6*a*, the re-used toner and the non-used toner are further mixed by the screw 7 disposed between the common portion 6*a* and the developing device 10, and then are sent to the developing device 10. Accordingly, in the illustrated embodiment, the re-used toner and the non-used toner can be well mixed with each other before they are introduced into the developing device 10 (Incidentally, the screw 7 may be disposed within the developing device 10). With the arrangement as mentioned above, there are provided the convey path 40 for supplying the re-used toner (from which the foreign matter is removed by the separating device 20) to the developing device 20 and the convey path 6 for supplying the non-used toner from the hopper 2 to the developing device 10, and the common portion 6*a* is defined by portions of the convey paths 40, 6 so that the re-used toner and the non-used toner are mixed with each other in the common portion 6*a*. After the re-used toner and the non-used toner are further mixed by the screw 7, they are supplied to the developing device 10. Further, they are further mixed by the agitating rods in the developing device. Accordingly, the completely mixed toner is sent to the developing area D of the developing sleeve 11.

Incidentally, when the non-used toner in the hopper 2 is consumed and the absence of toner (i.e., the fact that the toner in the hopper 2 is decreased below a predetermined amount) is detected by a sensor 4, a signal emitted from the sensor 4 is sent to the control portion 25, thereby stopping the image forming apparatus. Alternatively, in such a case, the apparatus is not stopped, but, the fact that toner should be replenished to the hopper may by displayed on a display 60. Since the new toner (non-used toner) and the re-used toner are sufficiently mixed with each other until the toner is supplied to the developing device 10, the toner may be directly sent to the proximity of the developing sleeve 11 without providing the agitating rods 8*a*, 8*b*.

By the way, the waste toner collected by the cleaning device 30 has often less charging ability than that of the new toner. Thus, depending upon a mixing ratio between the re-used toner and the new toner (non-used toner), it is a danger of decreasing the density of the toner supplied to the developing device 10, thereby deteriorating the image quality. That is to say, in the mixed toner, if the amount of the re-used toner is increased to some extent, the density of the mixed toner will be decreased. For example, from the test result, it was found that, when the amount of the re-used toner was about 30% (or less) of the total amount of toner to be supplied to the developing device 10, the density of the formed image was not decreased. Further, by maintaining the amount of the re-used toner to about 20% of the total amount of toner, it was found that the high quality image could always be obtained.

In consideration of the above, the mixing ratio between the non-used toner and the re-used toner may be controlled.

Figure 7:
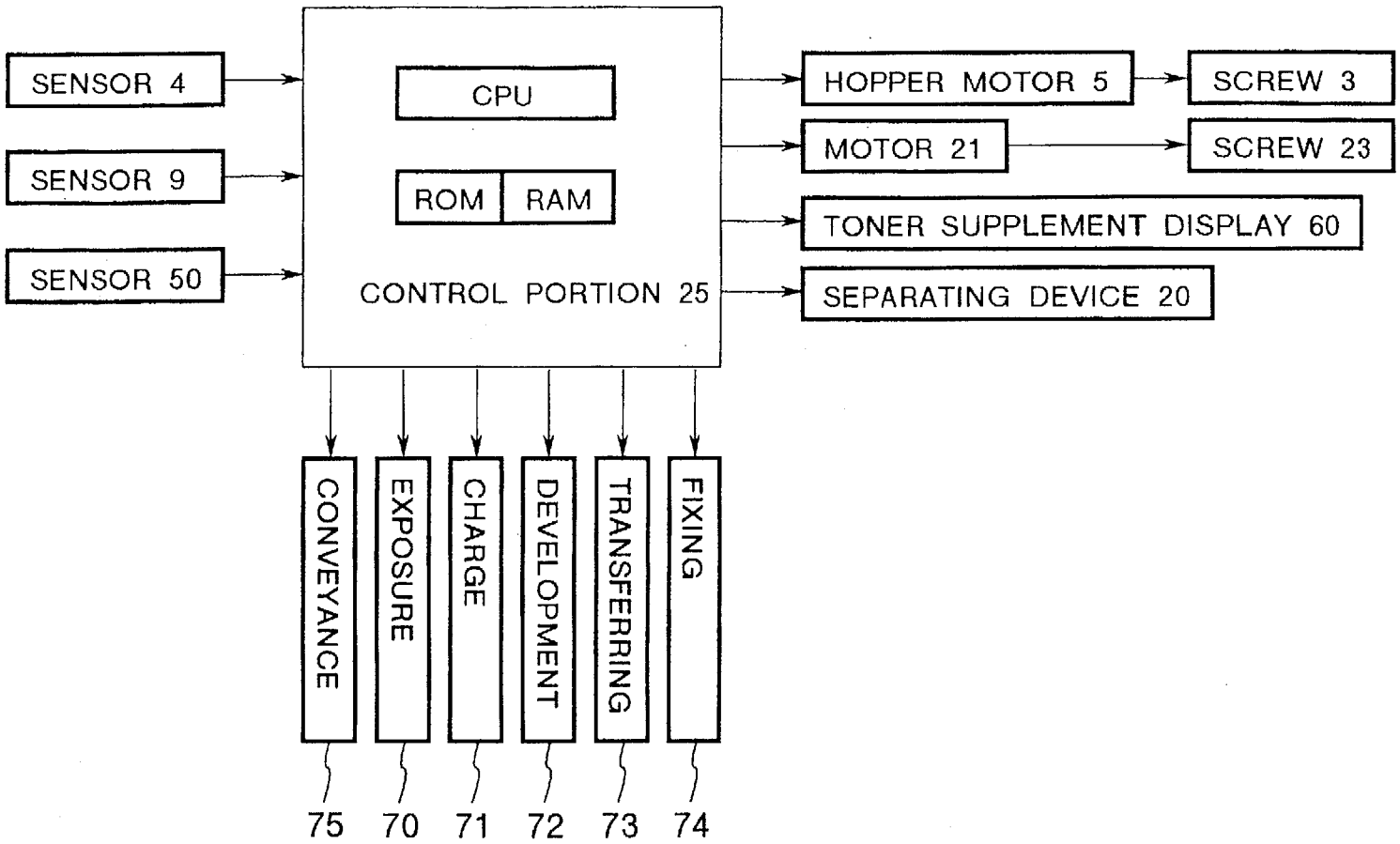
FIG. 7 is a block diagram of a control portion of the image forming apparatus.

As a method for controlling the mixing ratio between the new toner (non-used toner) and the re-used toner, when a lead of the convey screw 3 is the same as that of the convey screw 23, the total number of revolutions of the screw 3 may be changed from that of the screw 23 (i.e., the driving time period of the motor 5 for the hopper 2 may be changed from that of the motor period of the motor 5 for the hopper 2 may be changed from that of the motor 21 for the toner reservoir 26), or, when the driving time periods of the motors 5, 21 are the same as each other, the leads of the screws 3, 23 may be changed from each other or the number of revolutions per unit (RPM) of the screw 3 may be changed from that of the screw 23 (for example, by changing the gear ratio between the gears 22, 22*a*). That is to say, when the leads (sizes) of the screws 3, 23 are the same as each other, the driving time periods of the motors 5, 21 are controlled in accordance with the program stored in a ROM of the control portion 25. More specifically, the driving time periods of the motors 5, 21 are controlled so that the amount of the re-used toner supplied to the developing device 10 by the screw 23 becomes 30% (or less) of the total amount of toner supplied to the developing device 10 by the screws 3, 23. Alternatively, when the driving time periods of the motors 5, 21 controlled by the control portion 25 are the same as each other, the leads of the screws 3, 23 may be set so that a toner conveying amount of the screw 23 becomes 30% (or less) of a total toner conveying amount obtained by both screws 3, 23. Alternatively, when the driving time periods of the motors 5, 21 controlled by the control portion 25 are the same as each other, the gear ratio between the gears 22 of the motor 21 and the gear 22*a* of the screw 23 may be selected so that a toner conveying amount of the screw 23 becomes 30% (or less) of a total toner conveying amount obtained by both screws 3, 23. Incidentally, FIG. 7 shows a block diagram of the control portion 25.

Further, according to the illustrated embodiment, the capacity of the toner reservoir 26 provided in the separating device 20 may be selected as follows. That is to say, it is assumed that the capacity of the toner reservoir 26 provided in the separating device 20 is $V_{SUB}$, the toner amount in the developing device 10 immediately after the replenishment is $V_{DEV\ toner}$, and the toner amount when the toner absence is detected by the sensor 4 is $V_{DEV\ notoner}$. Further, the transfer efficiency is assumed to 80% in consideration of the worst transfer efficiency. In this case, if the following relation (1) between the reservoir capacity $V_{SUB}$ and the toner amount in the developing device 10 is not satisfied, the toner will overflow from the toner reservoir 26:

$$V_{SUB} \geqq 0.15\ (V_{DEV\ toner} - V_{DEV\ no\ toner}) \quad (1)$$

On the other hand, if it is assumed that the mixing ratio between the new toner (non-used toner) supplied from the hopper 2 and the re-used toner supplied from the reservoir 26 is 8:2, since the value of ($V_{DEV\ toner} - V_{DEV\ notoner}$) in the relation (1) represents the total toner amount replenished from the hopper 2 and the reservoir 26, the following relation is obtained:

$$V_{SUB} \geqq 0.2\ (V_{DEV\ toner} - V_{DEV\ notoner}) \quad (2)$$

After all, from the above relations (1) and (2), $V_{SUB}$ must satisfy the following relation:

$$V_{SUB} \geqq 0.2\ (V_{DEV\ toner} - V_{DEV\ notoner}) \quad (3)$$

That is to say, $V_{SUB}$ may be determined to satisfy the relation (3). More particularly, when the capacity of the toner reservoir 26 is selected to become 20% (or less) of the total toner amount to be replenished to the developing device 10, the toner can be prevented from overflowing from the reservoir 26. Further, after the toner is replenished to the developing device 10, no toner remains in the reservoir.

Next, another embodiment of the present invention will be explained. In this embodiment, the arrangement of the hopper 2 and the separating device 20 is changed.

Figure 3:
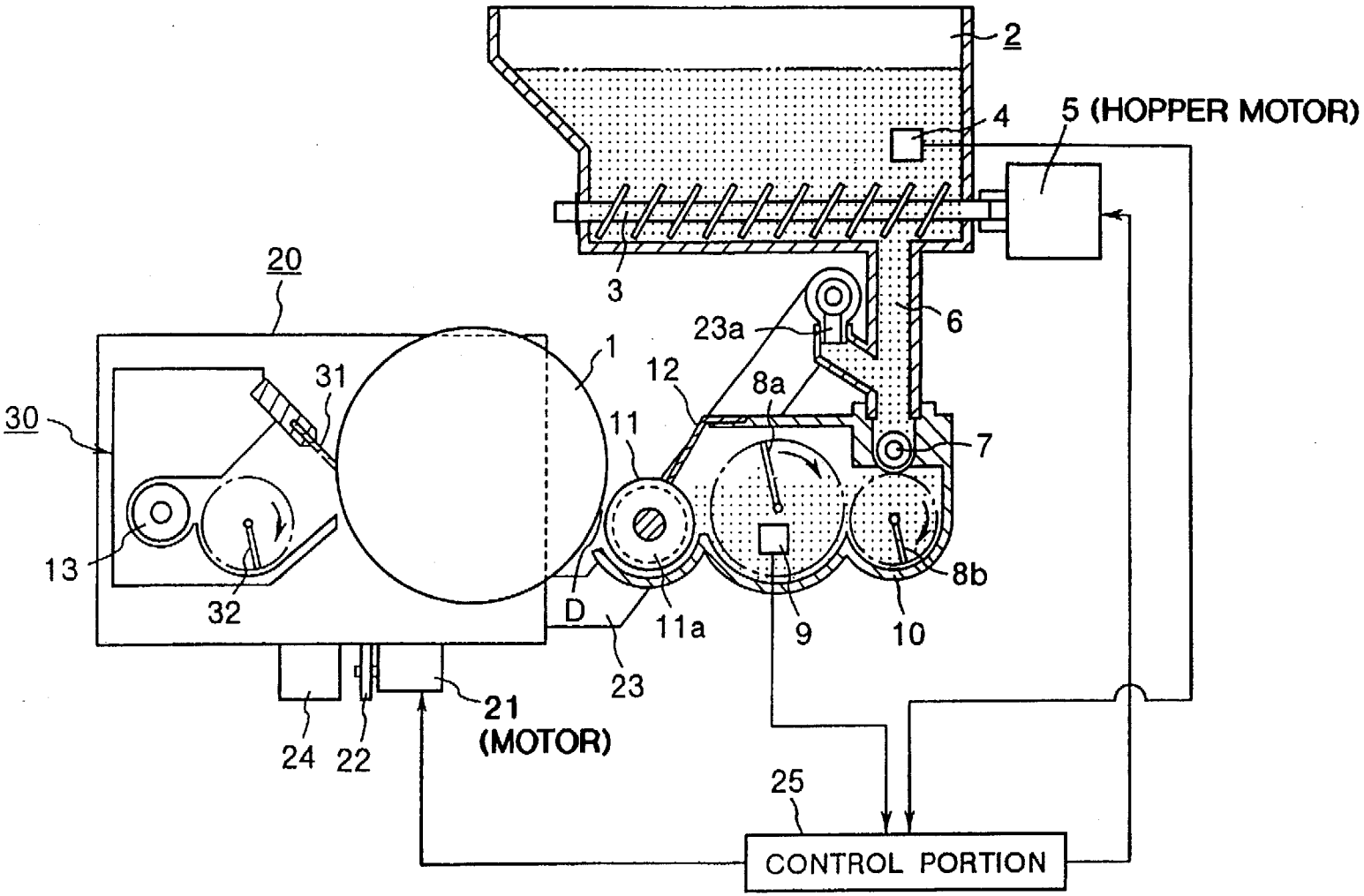
FIG. 3 is an elevational sectional view showing main portions of an image forming apparatus according to another embodiment of the present invention.
Figure 4:
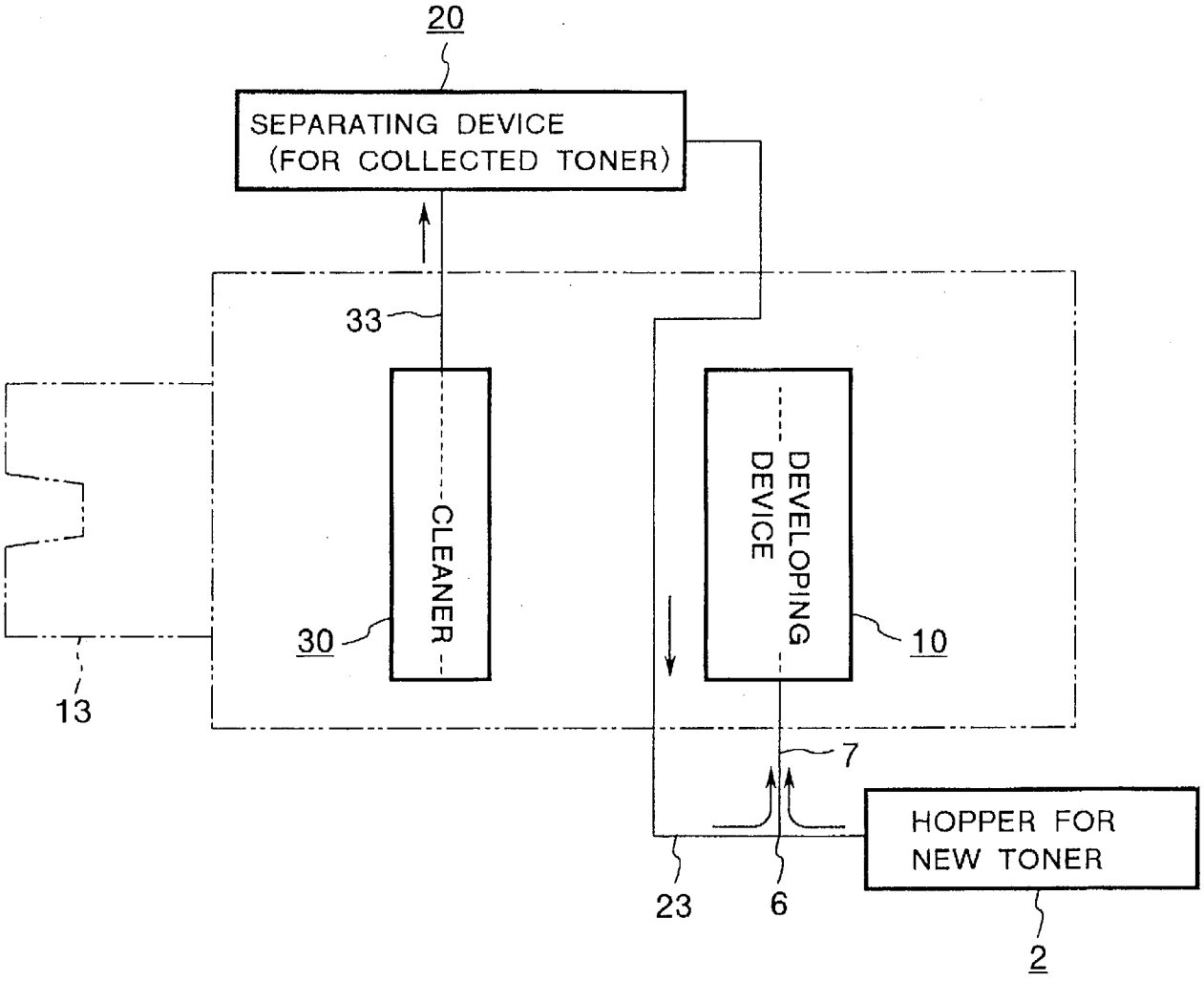
FIG. 4 is a view showing a positional relation between various elements of the image forming apparatus of FIG. 3.

FIG. 3 is an elevational sectional view of a main portion of an image forming apparatus according to this embodiment, and FIG. 4 is a schematic plan view of the apparatus.

As shown in FIGS. 3 and 4, according to this embodiment, in an image forming apparatus having the image bearing member 1, developing device 10 and cleaning device 30, the hopper 2 for replenishing the new toner to the developing device 2 ia arranged this side (lower side of the plane of FIG. 4) and the separating device 20 is arranged that side (upper side of the plane of FIG. 4) with respect to the image bearing member 1. Further, the screw 23 is disposed in a path connecting between the separating apparatus 20 and the convey path 6 of the hopper 2. Incidentally, the same elements as those of the first embodiment shown in FIGS. 1 and 2 are designated by the same reference numerals and explanation thereof will be omitted.

Figure 5:
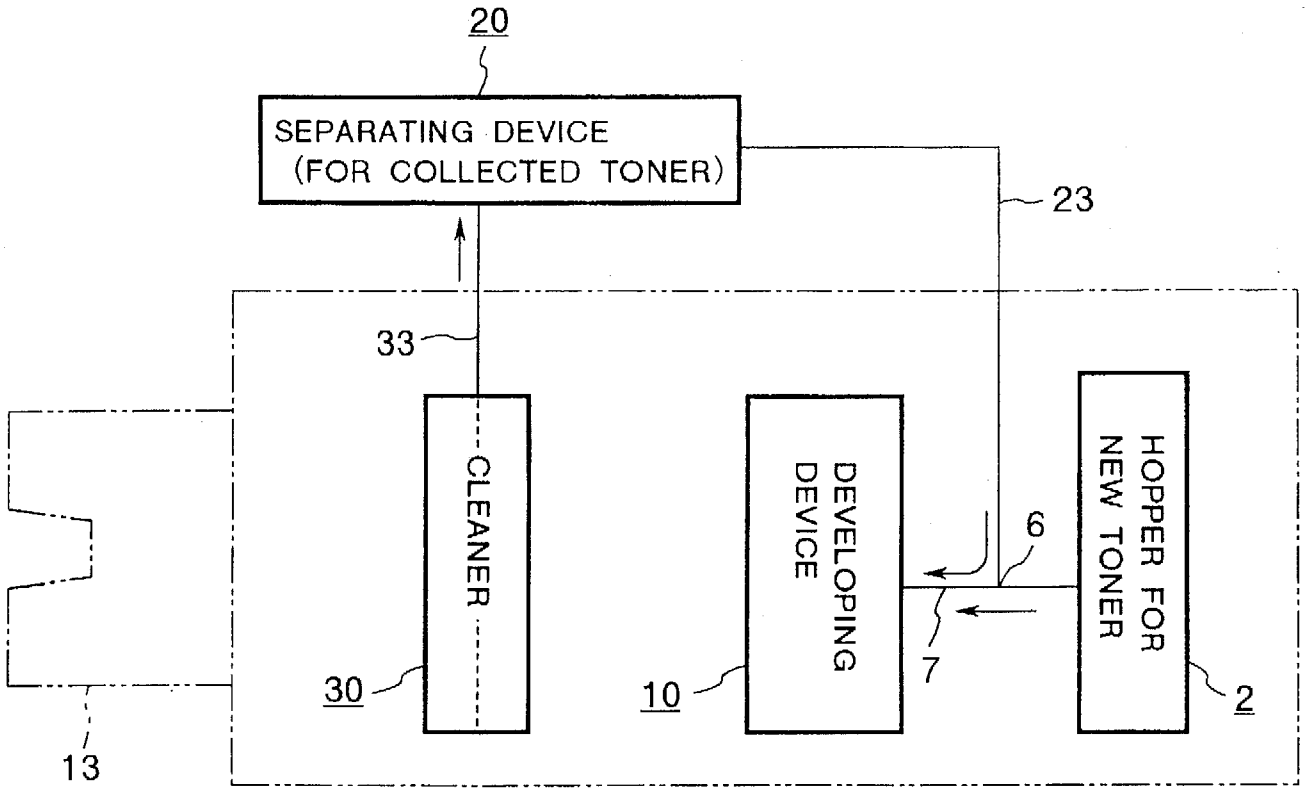
FIG. 5 is a view showing a positional relation between various elements of an image forming apparatus according to a further embodiment of the present invention.

A further embodiment is shown in FIG. 5. In this image forming apparatus, the hopper 2 is arranged centrally with respect to a longitudinal direction of the developing device 10, and the separating device 20 is arranged that side with respect to the image bearing member 1. Also, in this embodiment, the same elements as those of the first embodiment shown in FIGS. 1 and 2 are designated by the same reference numerals and explanation thereof will be omitted.

Next, the control portion 25 will be explained.

The control portion 25 serves to control the entire image forming apparatus and includes a CPU such as a microprocessor, a ROM for storing a control program and various data, and a RAM for temporarily storing various data and adapted to be used as a work area for the CPU. The control portion 25 receives signals from the sensor 4, sensor 9, and a group 50 of sensors including a sheet jam detection sensor (jam sensor). The control portion 25 controls the driving of the hopper motor 5 (screw 3) and the motor 21 (screw 23) on the basis of information from the sensor 9. Further the control portion 25 stops the entire operation of the image forming apparatus on the basis of information from the sensor 4. Alternatively, the fact that the toner should be replenished may be displayed on the display 60 without stopping the image forming apparatus. Further, the control portion 25 can control various processes such as an exposure process 70 (optical reading system 8), charge process 71 (charge means 7), development process 72 (developing device 10), transferring process 73 (transfer means 4) and fixing process 74 (fixing device 12), conveyance system 75 (sheet supply portion 35, sheet re-supply portion 16), and the separating device 20.

The arrangement of the hopper and the separating device as mentioned above can be appropriately selected 10 in consideration of the positions, dimensions and configurations of various parts, and the entire construction of the image forming apparatus.

Incidentally, in the above-mentioned embodiments, the separating device is not limited to the aforementioned one utilizing the magnetic forces, but may be appropriately designed in accordance with a feature of the toner. Further, the mechanism for mixing the re-used toner with the non-used toner is not limited to the aforementioned one including the screws, but may have any conventional design.

As mentioned above, the aforementioned embodiment relates to an image forming apparatus wherein the new toner is successively supplied from the hopper to the developing device at the developing station, the waste toner collected by the cleaning device at the cleaning station is sent to the separating device to separate the foreign matters from the magnetic toner, and the re-used toner and the new toner (non-used toner) are mixed with each other to be used in the development (the mixing ratio between the re-used toner and the non-used toner can be controlled). Thus, since the latent image can be developed with the toner which is uniform and does not include any foreign matter, high quality image can be obtained.

As mentioned above, according to the present invention, since, after the re-used toner was well mixed with the non-used toner, the mixed toner is used in the development, the high quality image can be obtained.

What is claimed is:

1. An image forming apparatus for forming an image on a recording medium, comprising:

an image bearing member;

a developing means for developing a latent image formed on said image bearing member;

a toner containing means for containing a non-used toner to be used in the development by said developing means;

a transfer means for transferring a toner image formed on said image bearing member by said developing means onto the recording medium;

a cleaning means for removing a residual matter adhered to said image bearing member after the toner image was transferred by said transfer means;

a separating means for separating foreign matter from toner removed from said image bearing member by said cleaning means; and a toner supplying means for supplying a toner mixture obtained by mixing a re-used toner from which the foreign matter has been removed by said separating means with the non-used toner from said toner containing means to said developing means.

2. An image forming apparatus according to claim 1, wherein the toner is magnetic toner, and said separating means comprises a filter having openings through which the magnetic toner can pass, and a magnetic field generating means for generating a magnetic field for attracting the magnetic toner through said filter, and wherein the foreign matter has been separated from the magnetic toner by blocking the foreign matter by said filter.

3. An image forming apparatus according to claim 1 or 2, wherein said toner supplying means has a first convey path for supplying the re-used toner from which the foreign matter has been removed by said separating means to said developing means, and a second convey path for supplying the non-used toner contained in said toner containing means to said developing means, and wherein a common convey path is defined by portion of said first and second convey paths, and the re-used toner and the non-used toner are mixed with each other as they pass through said common convey path.

4. An image forming apparatus according to claim 3, wherein said separating means comprises a reservoir means for temporarily storing the re-used toner from which the foreign matter has been removed by said separating means, before the re-used toner is supplied to said developing means.

5. An image forming apparatus according to claim 1 or 2, wherein said toner supplying means comprises a toner mixing means for mixing the re-used toner from which the foreign matter has been removed by said separating means with the non-used toner from said toner containing means.

6. An image forming apparatus according to claim 5, wherein said mixing means comprises a screw.

7. An image forming apparatus according to claim 1, wherein a first convey means for supplying the re-used toner from which the foreign matter has been removed by said separating means to said developing means, and a second convey means for supplying the non-used toner contained in said toner containing means to said developing means are driven by different motors.

8. An image forming apparatus according to claim 7, wherein an amount of the re-used toner supplied to said developing means by said first convey means is 30% or less of a total toner amount supplied to said developing means.

9. An image forming apparatus for forming an image on a recording medium, comprising:

an image bearing member;

a developing means for developing a latent image formed on said image bearing member;

a toner containing means for containing a non-used toner to be used in the development by said developing means;

a transfer means for transferring a toner image formed on said image bearing member by said developing means onto the recording medium;

a cleaning means for removing a residual matter adhered to said image bearing member after the toner image was transferred by said cleaning means;

a separating means for separating foreign matter from toner removed from said image bearing member by said cleaning means; and a reservoir means for temporarily storing re-used toner from which the foreign matter has been removed by said separating means, before the re-used toner is supplied to said developing means.

10. An image forming apparatus according to claim 9, wherein the toner is magnetic toner, and said separating means comprises a filter having openings through which the magnetic toner can pass, and a magnetic field generating means for generating a magnetic field for attracting the magnetic toner through said filter, and wherein the foreign matter has been separated from the magnetic toner by blocking the foreign matter by said filter.

11. An image forming apparatus according to claim 9 or 10, further comprising a first convey path for supplying the re-used toner from which the foreign matter has been removed by said separating means to said developing means, and a second convey path for supplying the non-used toner contained in said toner containing means to said developing means, and wherein a common convey path is defined by portion of said first and second convey paths, and the re-used toner and the non-used toner are mixed with each other as they pass through said common convey path.

12. An image forming apparatus according to claim 9, further comprising a toner mixing means for mixing the re-used toner from which the foreign matter has been removed by said separating means with the non-used toner from said toner containing means.

13. An image forming apparatus according to claim 11, further comprising a toner mixing means for mixing the re-used toner from which the foreign matter has been removed by said separating means with the non-used toner from said toner containing means.

14. An image forming apparatus according to claim 12, wherein said mixing means comprises a screw.

15. An image forming apparatus according to claim 9, wherein a first convey means for supplying the re-used toner from which the foreign matter has been removed by said separating means to said developing means, and a second convey means for supplying the non-used toner contained in said toner containing means to said developing means are driven by different motors.

16. An image forming apparatus according to claim 14, wherein a first convey means for supplying the re-used toner from which the foreign matter has been removed by said separating means to said developing means, and a second convey means for supplying the non-used toner contained in said toner containing means to said developing means are driven by different motors.

17. An image forming apparatus according to claim 16, wherein an amount of the re-used toner supplied to said developing means by said first convey means in 30% or less of a total toner amount supplied to said developing means.

18. An image forming apparatus for forming an image on a recording medium, comprising:

an image bearing member;

a developing means for developing a latent image formed on said image bearing member;

a toner containing means for containing a non-used toner to be used in the development by said developing means;

a transfer means for transferring a toner image formed on said image bearing member by said developing means onto the recording medium;

a cleaning means for removing a residual matter adhered to said image bearing member after the toner image was transferred by said transfer means;

a separating means for separating foreign matter from toner removed from said image bearing member by said cleaning means;

a reservoir means for temporarily storing re-used toner from which the foreign matter has been removed by said separating means, before the re-used toner is supplied to said developing means; and a toner supplying means for supplying a toner mixture obtained by mixing the re-used toner stored in said reservoir means with the non-used toner from said toner containing means to said developing means.

19. An image forming apparatus according to claim 18, wherein the toner is magnetic toner, and said separating means comprises a filter having openings through which the magnetic toner can pass, and a magnetic field generating means for generating a magnetic field for attracting the magnetic toner through said filter, and wherein the foreign matter has been separated from the magnetic toner by blocking the foreign matter by said filter.

20. An image forming apparatus according to claim 18 or 19, wherein said toner supply means comprises a first convey path for supplying the re-used toner from which the foreign matter has been removed by said separating means to said developing means, and a second convey path for supplying the non-used toner contained in said toner containing means to said developing means, and wherein a common convey path is defined by portion of said first and second convey paths, and the re-used toner and the non-used toner are mixed with each other as they pass through said common convey path.

21. An image forming apparatus according to claim 20, wherein said separating means comprises therein said reservoir means for temporarily storing the re-used toner from which the foreign matter has been removed by said separating means, before the re-used toner is supplied to said developing means.

22. An image forming apparatus according to claim 18 or 19, wherein said toner supplying means comprises a toner mixing means for mixing the re-used toner from which the foreign matter has been removed by said separating means with the non-used toner from said toner containing means.

23. An image forming apparatus according to claim 22, wherein said mixing means comprises a screw.

24. An image forming apparatus according to claim 18, wherein a first convey means for supplying the re-used toner from which the foreign matter has been removed by said separating means to said developing means, and a second convey means for supplying the non-used toner contained in said toner containing means to said developing means are driven by different motors.

25. An image forming apparatus according to claim 22, wherein a first convey means for supplying the re-used toner from which the foreign matter has been removed by said separating means to said developing means, and a second convey means for supplying the non-used toner contained in said toner containing means to said developing means are driven by different motors.

26. An image forming apparatus according to claim 24, wherein an amount of the re-used toner supplied to said developing means by said first convey means is 30% or less of a total toner amount supplied to said developing means.

27. An image forming apparatus according to claim 25, wherein an amount of the re-used toner supplied to said developing means by said first convey means is 30% or less of a total toner amount supplied to said developing means.

28. An image forming apparatus according to claim 5, wherein a first convey means for supplying the re-used toner from which the foreign matter has been removed by said separating means to said developing means, and a second convey means for supplying the non-used toner contained in said toner containing means to said developing means are driven by different motors.

29. An image forming apparatus according to claim 28, wherein an amount of the re-used toner supplied to said developing means by said first convey means is 30% or less of a total toner amount supplied to said developing means.

* * * * *

UNITED STATES PATENT AND TRADEMARK OFFICE

CERTIFICATE OF CORRECTION

PATENT NO. : 5,734,957 Page 1 of 2

DATED : March 31, 1998

INVENTOR(S) : OGAWA ET AL.

It is certified that error appears in the above-identified patent and that said Letters Patent is hereby corrected as shown below:

Column 1

Line 38, "prob-" should read --the prob- --.

Column 2

Line 32, "present" should read --present invention--.
Line 43, "are" should read --is--.

Column 4

Line 4, "are" should read --is--.
Line 11, "were" should read --is--.
Line 36, "$N_{17}S_{14}$" should read --$N_{17}>S_{14}$--.
Line 59, "are" should read --is--.

Column 6

Line 2, "were" should read --is--.

Column 7

Line 38, "reused" should read --re-used--.

Column 9

Line 46, "ia" should read --is--.

Column 10

Line 19, "10" should be deleted.

UNITED STATES PATENT AND TRADEMARK OFFICE

CERTIFICATE OF CORRECTION

PATENT NO. : 5,734,957

DATED : March 31, 1998

INVENTOR(S) : OGAWA ET AL.

It is certified that error appears in the above-identified patent and that said Letters Patent is hereby corrected as shown below:

Column 11

Line 18, "portion" should read --portions--.

Column 12

Line 15, "portion" should read --portions--.
Line 46, "in" should read --is--.

Column 13

Line 22, "portion" should read --portions--.

Signed and Sealed this

Third Day of November, 1998

*Attest:*

*Attesting Officer*

BRUCE LEHMAN

*Commissioner of Patents and Trademarks*